US008353684B2

(12) United States Patent
Peacock

(10) Patent No.: US 8,353,684 B2
(45) Date of Patent: Jan. 15, 2013

(54) PHASE CHANGE COMPRESSOR

(76) Inventor: Grant Peacock, Crawfordville, FL (US)

( * ) Notice: Subject to any disclaimer, the term of this patent is extended or adjusted under 35 U.S.C. 154(b) by 912 days.

(21) Appl. No.: 12/322,694

(22) Filed: Feb. 5, 2009

(65) Prior Publication Data

US 2010/0192568 A1 Aug. 5, 2010

(51) Int. Cl.
*F04B 17/00* (2006.01)
*F04B 35/00* (2006.01)

(52) U.S. Cl. ..... 417/379; 417/375; 417/383; 417/390; 417/244

(58) Field of Classification Search ..... 417/375, 417/379, 383, 244, 248, 376, 390
See application file for complete search history.

(56) References Cited

U.S. PATENT DOCUMENTS

| | | | | | |
|---|---|---|---|---|---|
| 2,389,067 | A | * | 11/1945 | Lieberman | 417/379 |
| 2,688,923 | A | * | 9/1954 | Bonaventura et al. | 417/379 |
| 2,867,974 | A | * | 1/1959 | Wenander | 60/531 |
| 3,604,822 | A | * | 9/1971 | Saxe | 417/339 |
| 3,937,599 | A | * | 2/1976 | Thureau et al. | 417/389 |
| 3,991,574 | A | * | 11/1976 | Frazier | 60/645 |
| 4,079,591 | A | | 3/1978 | Derby et al. | |
| 4,207,034 | A | * | 6/1980 | Zeimer | 417/379 |
| 4,229,661 | A | | 10/1980 | Mead et al. | |
| 4,370,559 | A | | 1/1983 | Langley, Jr. | |
| 4,427,350 | A | * | 1/1984 | O'Hare | 417/379 |
| 4,429,540 | A | * | 2/1984 | Burnham | 62/188 |
| 4,433,551 | A | | 2/1984 | Dibrell | |
| 4,451,210 | A | * | 5/1984 | Shaubach et al. | 417/52 |
| 4,519,749 | A | | 5/1985 | Baumberg | |
| 4,525,631 | A | | 6/1985 | Allison | |
| 4,666,376 | A | * | 5/1987 | Solomon | 417/379 |
| 4,739,620 | A | | 4/1988 | Pierce | |
| 5,000,003 | A | * | 3/1991 | Wicks | 60/618 |
| 5,114,318 | A | * | 5/1992 | Freeborn | 417/379 |
| 5,129,236 | A | * | 7/1992 | Solomon | 62/324.1 |
| 5,246,350 | A | * | 9/1993 | Lackstrom et al. | 417/379 |
| 5,537,822 | A | | 7/1996 | Shnaid et al. | |
| 5,870,892 | A | * | 2/1999 | Gamoso | 60/413 |
| 6,033,192 | A | * | 3/2000 | Wood | 417/395 |
| 6,820,420 | B2 | * | 11/2004 | Hebert | 60/641.7 |
| 6,959,546 | B2 | | 11/2005 | Corcoran | |
| 7,086,231 | B2 | | 8/2006 | Pinkerton | |
| 2007/0065300 | A1 | * | 3/2007 | Mariani et al. | 417/243 |
| 2007/0128050 | A1 | * | 6/2007 | Cedrone et al. | 417/244 |
| 2008/0008602 | A1 | * | 1/2008 | Pozivil et al. | 417/243 |

* cited by examiner

*Primary Examiner* — Anne Hines
*Assistant Examiner* — Jose M Diaz
(74) *Attorney, Agent, or Firm* — J. Wiley Horton

(57) ABSTRACT

A method for compressing a gas by using energy produced from a heat source. A boiler is provided. The boiler is segregated into an upper chamber and a lower chamber by a barrier such as a piston, a bellows, or a diaphragm. The lower chamber is filled with a liquid having a suitable boiling point and other properties. The upper chamber is filled with a gas to be compressed. Heat from any suitable source is applied to the liquid in the lower chamber in order to bring the liquid to a boil, and thereby produce pressurized vapor in the lower chamber. The rising pressure in the lower chamber moves the barrier in the direction of the upper chamber, thereby compressing the gas in the upper chamber.

20 Claims, 5 Drawing Sheets

PHASE CHANGE COMPRESSOR

CROSS-REFERENCES TO RELATED APPLICATIONS

Not Applicable.

STATEMENT REGARDING FEDERALLY SPONSORED RESEARCH OR DEVELOPMENT

Not Applicable.

MICROFICHE APPENDIX

Not Applicable

BACKGROUND OF THE INVENTION

1. Field of the Invention

The present invention relates to the field of gas compressors. More specifically, the invention comprises a device which uses an available heat source to change a working fluid from a liquid to a first gas, and use the pressure of the first gas to compress a second gas.

2. Description of the Related Art

Gas compressors have been in common use for many years. Reciprocating (piston) compressors and rotary compressors each pull in air under ambient conditions and increase its pressure. The pressurized air is then typically stored and dispensed to perform work such as powering air tools, spray guns, etc. While these devices perform adequately, they consume a significant amount of energy. The input energy is usually in the form of electricity or fossil fuel.

The present invention seeks to compress gas using only an available heat source. Any heat source capable of boiling a suitable working fluid will suffice. However, one particularly useful application for the invention involves the use of a "free" heat source such as waste heat or solar energy.

BRIEF SUMMARY OF THE INVENTION

The present invention is a method for compressing a gas by using energy produced from a heat source. A boiler is provided. The boiler is segregated into an upper chamber and a lower chamber by a barrier such as a piston or diaphragm. The lower chamber is filled with a liquid having a suitable boiling point and other properties. The upper chamber is filled with a gas to be compressed.

Heat from any suitable source is applied to the liquid in the lower chamber in order to bring the liquid to a boil, and thereby produce pressurized vapor in the lower chamber. The rising pressure in the lower chamber moves the barrier in the direction of the upper chamber, thereby compressing the gas in the upper chamber. The compressed gas in the upper chamber is transferred to a storage tank. The heat is then removed from the lower chamber and the barrier gradually returns to its original position. Once the barrier resumes its original state, a new charge of low pressure gas is established in the upper chamber and the process may then be repeated.

Figure 1:
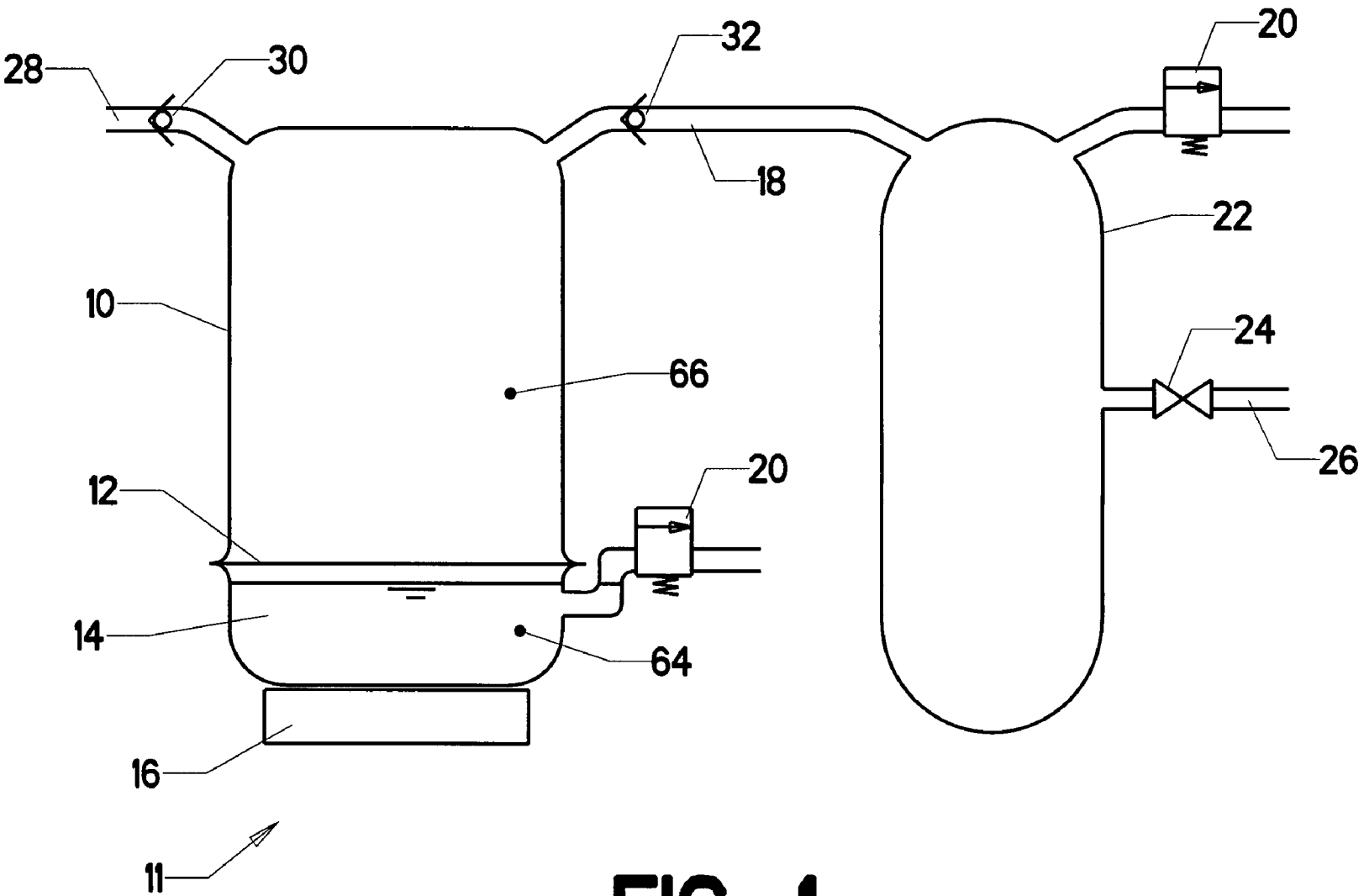
FIG. 1 is a schematic view, showing the components of the present invention.

| REFERENCE NUMERALS IN THE DRAWINGS | |
|---|---|
| 10 | boiler |
| 12 | diaphragm |
| 14 | liquid |
| 16 | heat source |
| 18 | transfer line |
| 20 | relief valve |
| 22 | storage tank |
| 24 | control valve |
| 26 | output line |
| 28 | intake line |
| 30 | input check valve |
| 32 | output check valve |
| 34 | vapor |
| 36 | first boiler |
| 38 | second boiler |
| 40 | first heat source |
| 42 | second heat source |
| 44 | first storage tank |
| 46 | second storage tank |
| 48 | first transfer line |
| 50 | second transfer line |
| 51 | third transfer line |
| 52 | first relief valve |
| 54 | second relief valve |
| 56 | first transfer check valve |
| 58 | second transfer check valve |
| 60 | third transfer check valve |
| 62 | piston |
| 64 | lower chamber |
| 66 | upper chamber |

DETAILED DESCRIPTION OF THE INVENTION

One embodiment of the proposed invention is depicted in FIG. 1. Boiler 10 is a sealed vessel which is segregated into upper chamber 66 and lower chamber 64 by a movable barrier. In this particular example, the movable barrier is diaphragm 12, which is a sheet of elastic material. Intake line 28 connects upper chamber 66 to an external supply of gas which is to be compressed. The external gas supply can simply be the surrounding atmosphere.

Input check valve 30 regulates the flow of gas through intake line 28. The input check valve may be a simple one-way valve which allows flow from the external gas supply into upper chamber 66 whenever the pressure of the external gas supply exceeds the pressure in the upper chamber. Such a valve closes once the pressure within the upper chamber exceeds that of the external gas supply. Of course, input check valve 30 (as well as all other check valves described hereinafter) could assume many forms and could even be electronic valves under the control of a microprocessor.

Transfer line 18 connects upper chamber 66 to storage tank 22. Output check valve 32 is provided in this line. Output check valve 32 opens to allow gas to flow from upper chamber 66 into storage tank 22 whenever the pressure within the upper chamber exceeds that of the storage tank. Whenever the pressure within the upper chamber drops below that of the storage tank, output check valve 32 closes and prevents flow back from the storage tank into the boiler.

Relief valves 20 are preferably provided to limit the maximum pressure which can be reached within the storage tank and the boiler. Storage tank 22 is also preferably provided with output line 26 and control valve 24. Control valve 24 is used to control the flow of pressurized gas from the storage tank out the output line. Compressed gas flowing out the output line is used for any suitable purpose, such as powering air tools, spray guns, electrical generators, etc.

Having described the components of the invention, its operation will now be discussed. For this example, the reader should assume that the external supply of gas is ambient air (at 1 atmosphere of pressure) and that the pressure within the upper chamber, the lower chamber, and the storage tank are all equal at 1 atm. A suitable heat source 16 is applied to lower chamber 64 in order to boil liquid 14 contained within the lower chamber. This heat source could be a burner, a solar collector, waste heat, or any other source providing adequate heat transfer at an adequate temperature. The boiling liquid produces vapor which increases the pressure within lower chamber 64. This increasing pressure deforms diaphragm 14 upward into the upper chamber, which increases the pressure in the upper chamber.

Figure 2:
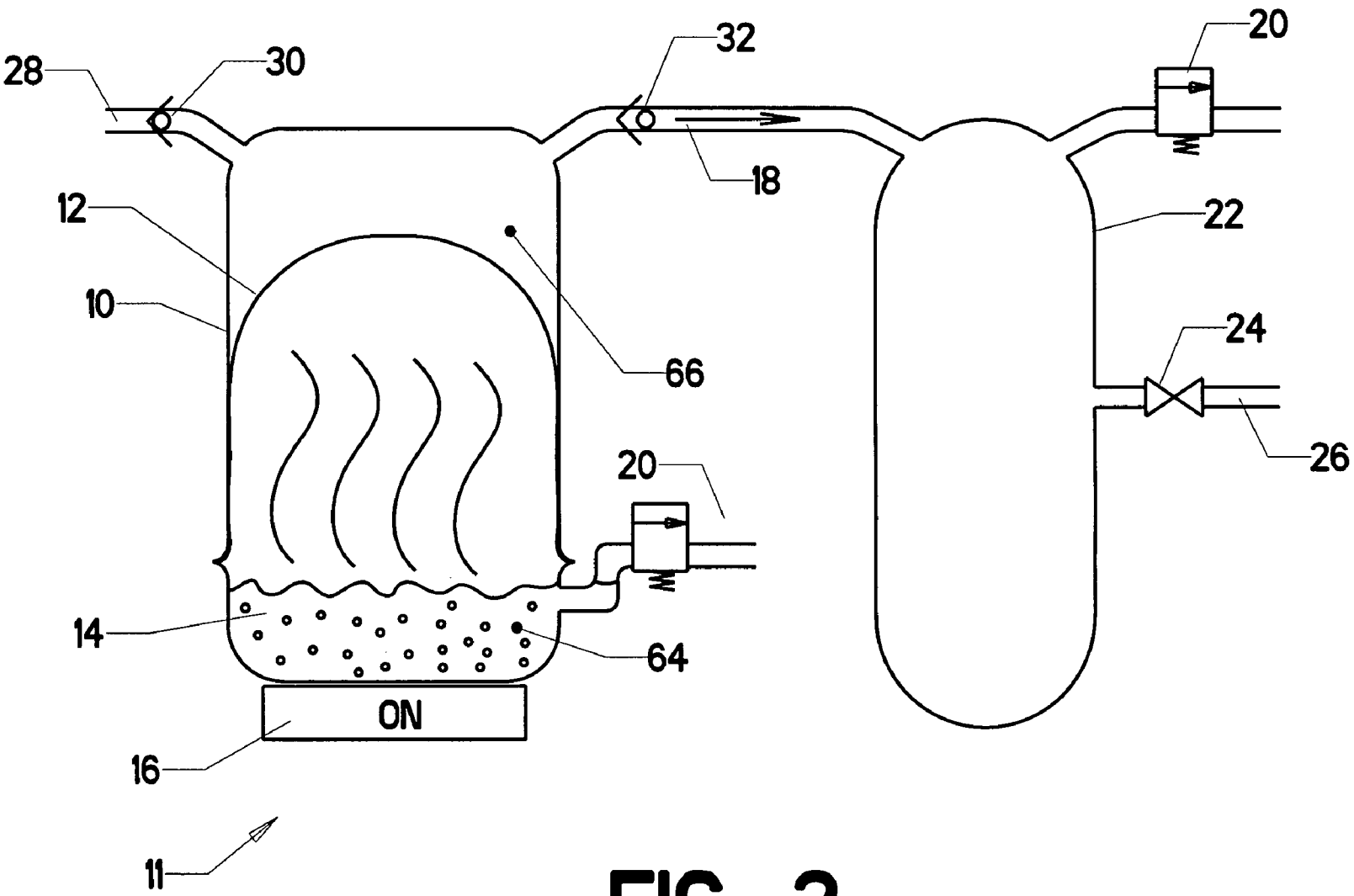
FIG. 2 is a schematic view, showing the operation of the components shown in FIG. 1.

Input check valve 30 closes, while output check valve 32 opens. FIG. 2 shows the condition within boiler 10 after a significant amount of liquid 14 has been vaporized. As long as a sufficient heat transfer rate is available via heat source 16, the pressure in boiler 10 can be raised to any selected level (with the limits of safety). The air originally within the upper chamber has been compressed and fed into storage tank 22.

Figure 3:
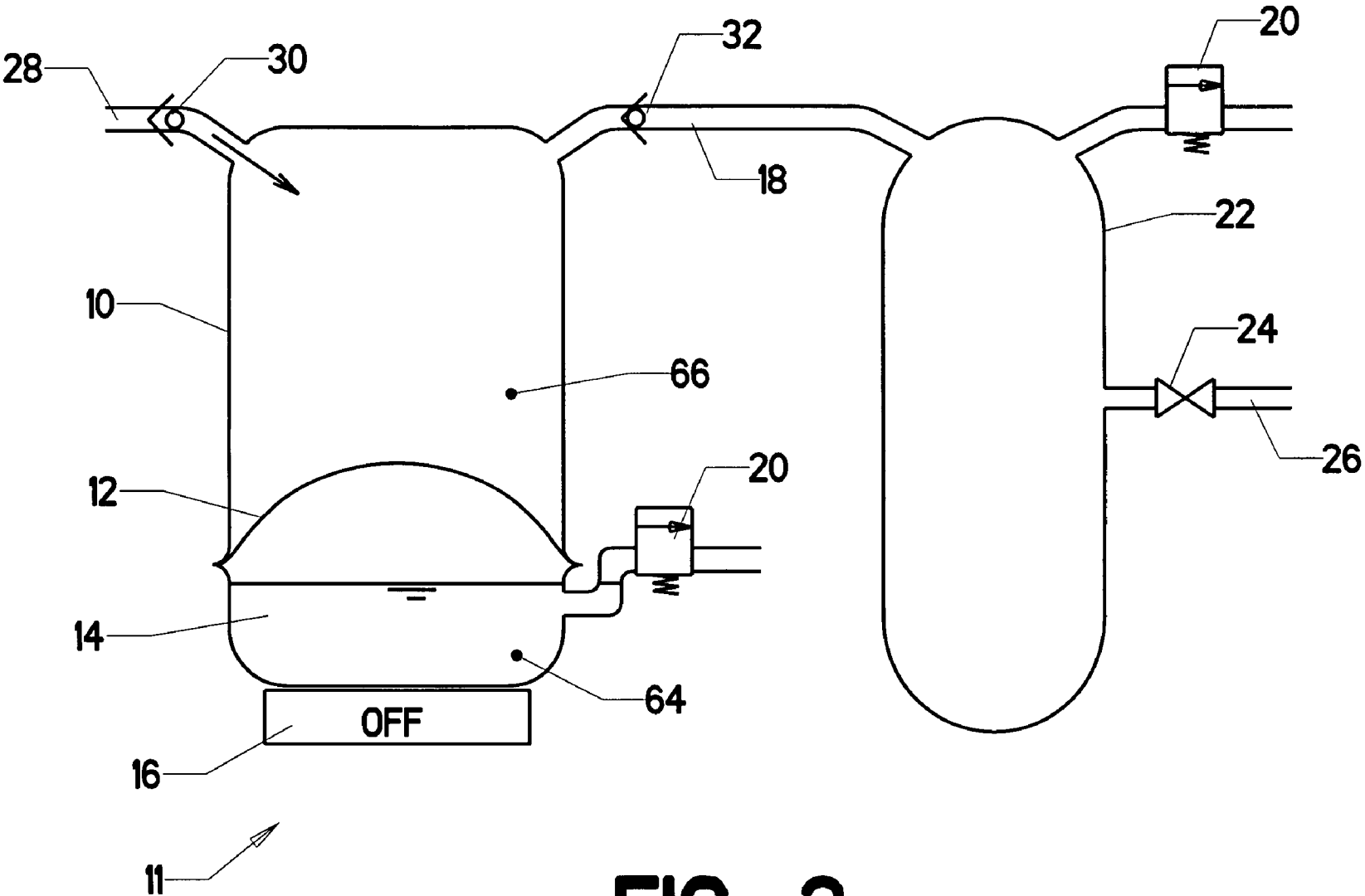
FIG. 3 is a schematic view, showing the continued operation of the components shown in FIG. 1.

Once the desired level of compression has been achieved, the heat source is removed. FIG. 3 depicts this part of the process. Liquid 14 has quit boiling and the vapor produced previously is condensing to a liquid within lower chamber 64. Diaphragm 12 is contracting back toward its original position. The pressure within upper chamber 66 is at this point lower than the pressure within the storage tank, so output check valve 32 has closed to prevent any back flow.

The boiler continues to cool until it reaches ambient conditions. Because a large percentage of the mass of gas originally within the upper chamber has been transferred to the storage tank, the reduction in temperature to ambient conditions will actually produce a slight vacuum in the upper chamber. Input check valve 30 will then open and admit gas from the external source until the pressure is again equalized. At that point the cycle can repeat, with the conditions again being shown as in FIG. 1.

Those skilled in the art will thereby appreciate that the inventive process can be cyclically performed in order to compress a gas and store it in storage tank 22. The number of cycles is practically limited by the fact that the pressure within upper chamber 66 must exceed that within storage tank 22 in order to transfer additional gas into the storage tank. A limit on pressure within the boiler will eventually be reached (depending upon the temperature and the heat exchange rate from the energy source being used). However, the invention contemplates that pressurized gas will be removed from the storage tank from time to time by opening control valve 24. If some of the pressurized gas is bled from the storage tank then the compression process can resume. It is desirable to minimize the heat transfer to the gas within the upper chamber as some of the compressive effect would then be lost as it cools.

The inventive process is well suited for taking advantage of many heat sources. One example is a low temperature heat source, which would include such things as solar collectors and waste heat from an internal combustion engine. Such a source might only have a temperature of 130 degrees Celsius (403 K). If water is used as the liquid in the boiler, the 130 degree heat source can easily boil the water at atmospheric pressure (1.0 bar). Steam will thereby be created and the compression cycle will begin. This will continue until the pressure within the boiler approaches the boiling pressure of water at the temperature of the heat source. At 130 degrees Celsius, water boils at a pressure of 2.7 bar or below. Thus, the system shown in FIG. 1 can achieve a theoretical maximum compression ration of 2.7 to 1.

This can be contrasted with simply using the heat source to heat the gas directly. The ideal gas law is typically stated as PV=nRT. In the case of direct heating, temperature is the only term that varies. The variation in pressure within a sealed chamber is then proportional to the variation in temperature. If the gas is loaded with an ambient temperature of 20 degrees Celsius (293 K) and heated to a temperature of 130 degrees Celsius (403 K), then the resulting final pressure will be 403/293 or 1.38 times the ambient pressure. Thus, simple heating produces a compression of only 1.38 to 1 (and this effect is obviously transitory since the gas will cool).

The advantage of the present invention is even greater when a higher temperature heat source is available. Consider a heat source of 181 degrees Celsius (454 K). The pressure of water boiling with heat being transferred at 454 K will stabilize around 10.0 bars. Thus, the compression available using a 454 K heat source will approach 10 to 1.

Of course, it may be advisable to select a working fluid other than water in order to make the most efficient use of various heat sources. The following table presents physical properties of some suitable working fluids:

TABLE I

| Common Name | IUPAC Name | Mol. Wt. (g/mol) | F.P. (° C.) | B.P. (° C.) |
|---|---|---|---|---|
| R-22 | chloro-difluoro methane | 86 | −135 | −40.8 |
| R-114 | 1,2-dichloro-1,1,1,2-tetrafluorethane | 171 | −94 | 3.6 |
| R-133a | 1-chloro-1,1,1-trifluoro ethane | 118 | −106 | 6.9 |
| R-134a | 1,1,1,2-tetrafluoro-ethane | 102.03 | — | −26.5 |
| ammonia | ammonia | 17.03 | −77.7 | −33.4 |
| toluene | methyl benzene | 92.1 | −95 | 110 |
| butane | butane | 73.1 | −138.4 | −0.5 |
| Dowtherm E | 0-dichlorobenzene | 166 | −48 | |
| Genetron 245fa | 1,1,1,3,3-pentafluoro-propane | 134 | | 15.3 |

As an example, a low temperature waste heat source of 40 degrees Celsius might suggest the use of R-114 rather than water.

The amount of pressure increase available for the embodiment illustrated in FIGS. 1-3 is ultimately limited by the temperature of the heat source and/or the practical working pressure limit of the boiler. The flow of gas is regulated by the pressure difference between the boiler and the storage tank. However, as mentioned previously, output check valve 32 can assume many forms. It may be desirable in some circumstances to include a pressure regulation function in this valve. As an example, output check valve 32 could be configured to remain closed until the pressure within the boiler was 2.0 bar above the pressure within the storage tank. This would permit no flow in the initial phase of the compression cycle.

Figure 4:
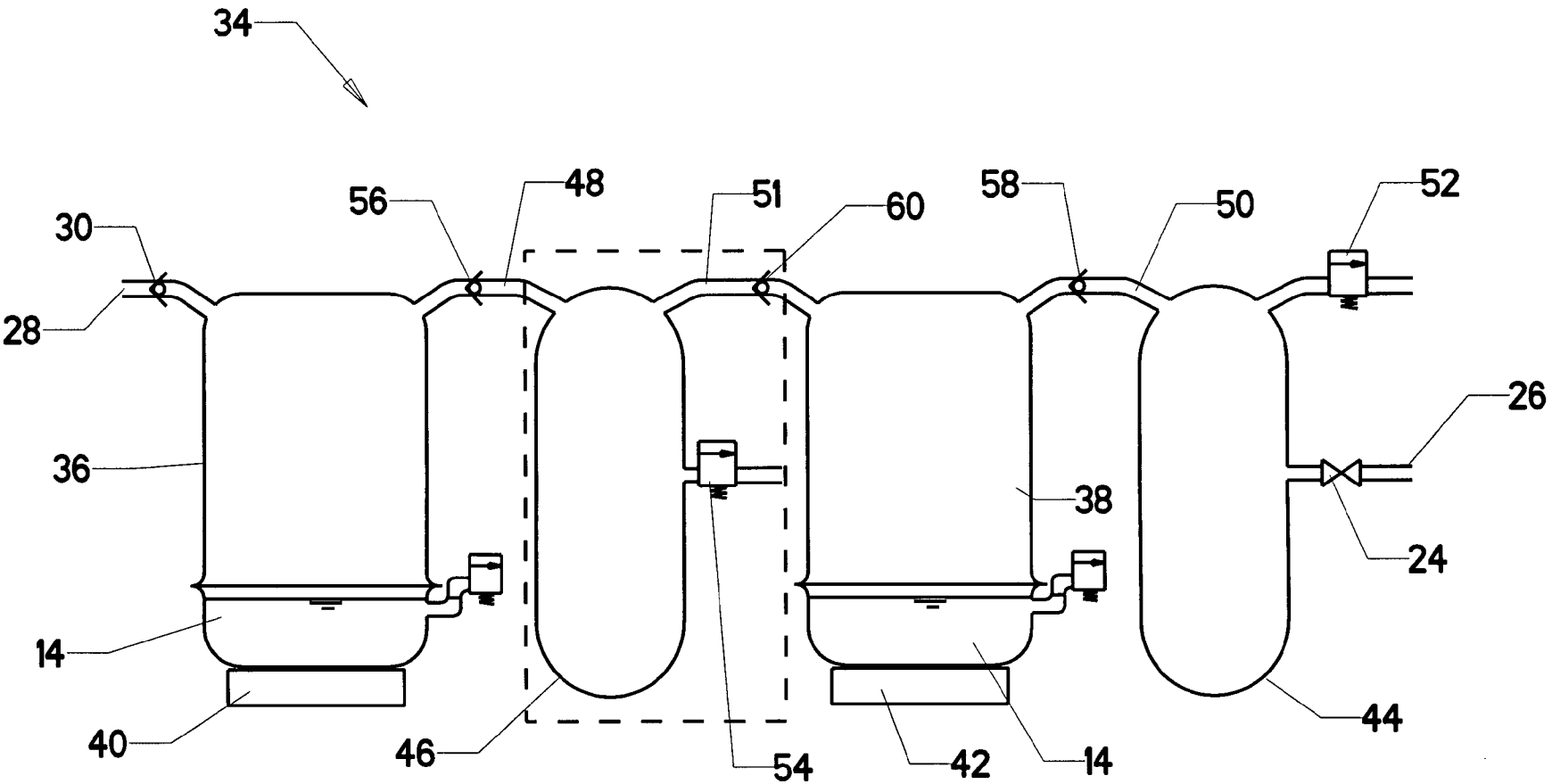
FIG. 4 is a schematic view showing a multi-stage gas compressor.

As discussed previously, the embodiment of FIGS. 1-3 is ultimately limited in the amount of compression it can provide. However, it is also possible to build a multi-staged version which can create much higher compression ratios. FIG. 4 shows a two-stage embodiment designated as multi-stage compressor 34. First boiler 36 and second boiler 38 feature the same components as illustrated in FIG. 1. Intake line 28 and input check valve 30 regulate the flow of gas from an external source into first boiler 36.

First transfer line 48 is positioned to transfer gas between the first and second boilers. First transfer check valve 56 is located in this line An optional second storage tank 46 is shown in position between the first and second boilers. This can be used to store the gas while it is being transferred. It is also possible to transfer gas directly from the first boiler to the second boiler with no intervening storage tank.

If a second storage tank is used, then third transfer line 51 is employed to transfer gas from second storage tank 46 to second boiler 38. Third transfer check valve 60 regulates the flow through the third transfer line. Second relief valve 54 is preferably installed to prevent an excessive build-up of pressure in the second storage tank (and indirectly in the first boiler as well).

Second transfer line 50 is positioned to transfer gas from the upper chamber of second boiler 38 to first storage tank 44. Second transfer check valve 58 regulates the flow of gas in this line. First relief valve 52 is preferably provided to prevent an excessive build-up of pressure within the first storage tank (and indirectly within the second boiler as well). The first storage tank is preferably equipped with output line 26 which is regulated by control valve 24.

A liquid is provided in the lower chamber of each of the two boilers. However, the reader should bear in mind that these may or may not be the same liquid. First heat source 40 and second heat source 42 may operate at different temperatures. As one example, the liquid in the first boiler might be R-114 while the liquid in the second boiler might be water. Of course, it is also possible to use the same liquid in both boilers.

The multi-stage gas compressor of FIG. 4 is designed to operate in sequence or with both boilers running simultaneously. The first boiler compresses the gas from an external source to a first level of compression and this gas is then fed into the second boiler. The second boiler further compresses the gas before feeding it into the first storage tank. The presence of second storage tank 46 allows both boilers to be operated simultaneously (once an initial level of pressure has been established within the second storage tank via the operation of the first boiler alone).

The use of a multi-stage approach allows significantly higher pressures to be obtained. If, for example, each stage achieves a 4 to 1 compression ratio, then the two stage embodiment would achieve an overall compression ratio of 16 to 1. It is also possible to add more stages. A compressor having three, four, or more stages is possible using the present invention.

Figure 5:
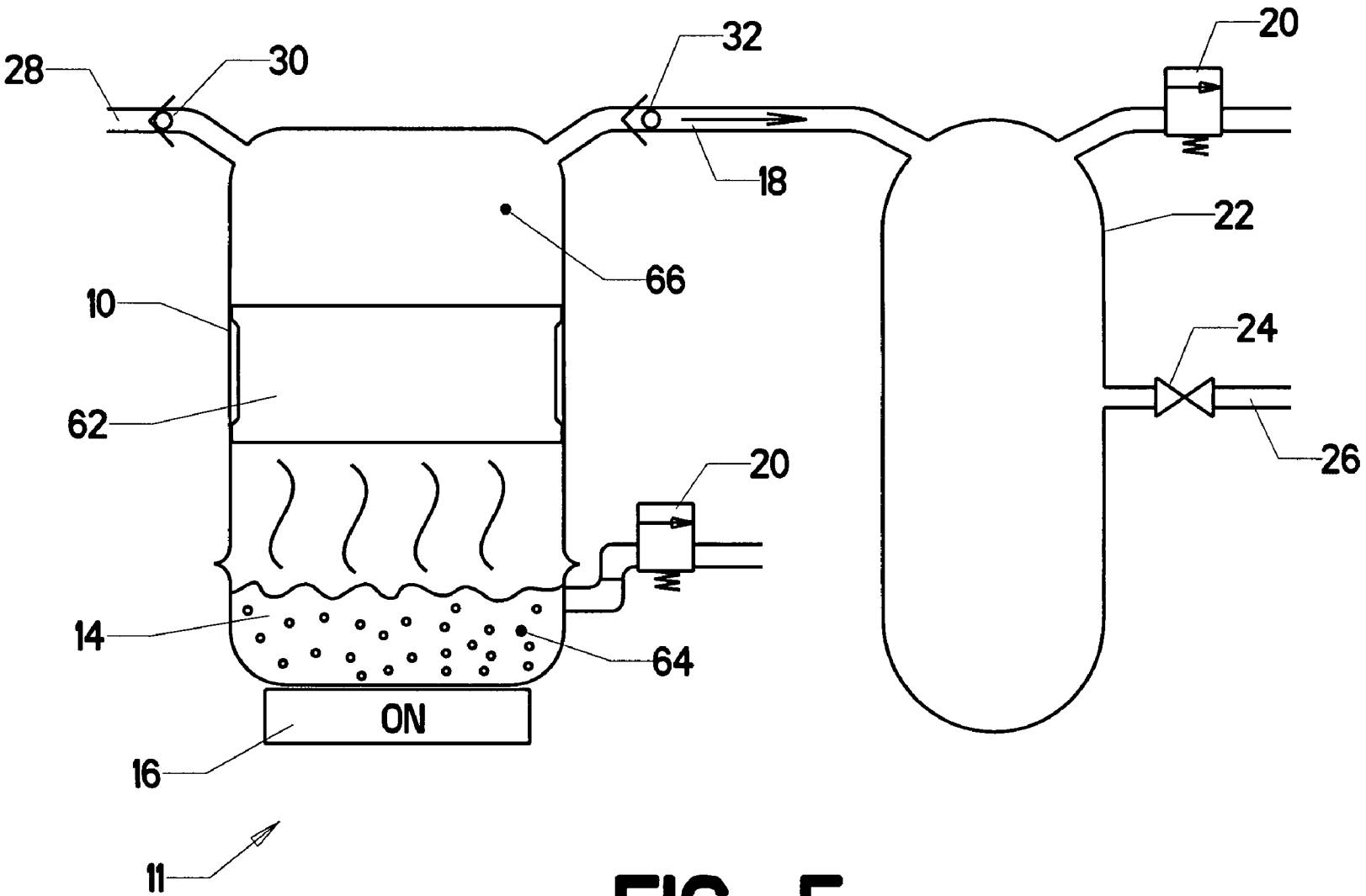
FIG. 5 is a schematic view, showing the use of a piston for a barrier rather than a diaphragm.

The inventive method can also be carried out using different hardware from that depicted in FIGS. 1 to 4. The upper and lower chambers in each boiler are separated by a moveable barrier. As one example, the movable barrier can assume many forms. This barrier can be a flexible diaphragm, a bellows, a flexible moving barrier, or a solid moving barrier such as a piston. FIG. 5 shows an embodiment featuring a piston 62 moving up and down within boiler 10. The piston can be biased downward by a spring, its own weight, or a combination of the two. It still serves to segregate the two chambers, though some small amount of "blow-by" is likely for higher pressure operations.

Multiple boilers can be connected to the same storage tank so that compressed gas is fed more or less continuously. Many combinations of serial-staged or parallel-staged boilers can be conceived. One need only to arrange the appropriate transfer lines and check valves.

The compression used in the inventive process is preferably produced by boiling a liquid to create a phase change. This is by no means the only way to use a heat source to create compression. One other approach would be the use of a heat source to initiate a chemical reaction in the lower chamber which then produces a gas and consequent increasing pressure.

The gas compressed using the inventive process has many conceivable applications. Compressed air can be used to run air tools. A compressed refrigerant—such as R-22—can be stored and subsequently used to run a refrigeration cycle.

The reader will thereby appreciate how the presently disclosed invention can take gas from an external source and compress it by a factor of two or more times using a heat source to provide the energy needed for this compression. Although the preceding description contains significant detail, it should not be construed as limiting the scope of the invention but rather as providing illustrations of the preferred embodiments of the invention. Thus, the scope of the invention should be fixed by the claims, rather than by the examples given.

Having described my invention, I claim:

1. A method for compressing and storing a gas, comprising:

a. providing a boiler, said boiler being segregated by a movable barrier into an upper chamber above said movable barrier and a lower chamber below said movable barrier, said movable barrier remaining within said boiler;

b. drawing said gas to be compress into said upper chamber of said boiler;

c. providing a liquid in said lower chamber;

d. providing a storage tank;

e. providing a transfer line between said upper chamber and said storage tank;

f. providing an output check valve in said transfer line movable between an open position and a closed position;

g. applying sufficient heat to said liquid in said lower chamber to boil said liquid and convert at least a portion of said liquid into a pressurized vapor, thereby moving said movable barrier toward said upper chamber and compressing said gas within said upper chamber;

h. opening said output check valve in said transfer line in order to allow said pressurized gas within said upper chamber to move through said transfer line and into said storage tank until such time as the pressure within said upper chamber and said storage tank are substantially equal; and i. closing said output check valve in said transfer line in order to seal said pressurized gas within said storage tank.

2. A method as recited in claim 1, wherein said output check valve in said transfer line is an automatic valve which opens whenever said pressure in said upper chamber exceeds said pressure within said storage tank.

3. A method as recited in claim 1, further comprising:

a. providing an intake line connecting said upper chamber to an external source of gas;

b. providing an input check valve in said intake line movable between an open position and a closed position;

c. opening said input check valve in order to perform said step of drawing said gas to be compressed into said upper chamber; and d. closing said input check valve.

4. A method as recited in claim 1 wherein said step of applying sufficient heat to said liquid is performed by applying heat from a source selected from the group consisting of solar energy, waste heat, and geothermal energy.

5. A method as recited in claim 1, further comprising providing a relief valve which limits the pressure which can be generated within said boiler.

6. A method as recited in claim 1, further comprising:

a. providing an output line connected to said storage tank; and b. providing a control valve in said output line movable between an open position and a closed position.

7. A method as recited in claim 1, wherein said movable barrier is an expandable diaphragm.

8. A method as recited in claim 1, wherein said movable barrier is selected from the group consisting of a piston or a bellows.

9. A method for compressing and storing a gas, comprising:

a. providing a first boiler, said first boiler being segregated by a movable barrier into an upper chamber above said movable barrier and a lower chamber below said movable barrier, said movable barrier remaining within said boiler;

b. providing a second boiler, said second boiler being segregated by a movable barrier into an upper chamber above said movable barrier and a lower chamber below said movable barrier said barrier, said barrier remaining within said second boiler;

c. providing a first transfer line between said first boiler and said second boiler;

d. providing a first transfer check valve in said first transfer line movable between an open position and a closed position;

e. providing a first storage tank;

f. providing a second transfer line between said second boiler and said storage tank;

g. providing a second transfer check valve in said second transfer line movable between an open position and a closed position;

h. providing a first liquid in said lower chamber of said first boiler;

i. providing a second liquid in said lower chamber of said second boiler;

j. providing an external source of gas to be compressed in said upper chamber of said first boiler;

k. applying sufficient heat to said first liquid in said lower chamber of said first boiler to convert at least a portion of said first liquid into a pressurized vapor, thereby moving said movable barrier within said first boiler toward said upper chamber and compressing said gas within said upper chamber of said first boiler;

l. opening said first transfer check valve in said first transfer line in order to allow said pressurized gas in said upper chamber of said first boiler to move into said upper chamber of said second boiler until such time as the pressure within said upper chamber of said second boiler and said upper chamber of said first boiler are substantially equal;

m. closing said first transfer check valve;

n. applying sufficient heat to said second liquid in said lower chamber of said second boiler to convert at least a portion of said second liquid into a pressurized vapor, thereby moving said movable barrier within said second boiler toward said upper chamber and further compressing said gas within said upper chamber of said second boiler;

o. opening said second transfer check valve in said second transfer line in order to allow said further pressurized gas in said upper chamber of said second boiler to move into said first storage tank until such time as the pressure within said first storage tank and said upper chamber of said second boiler are substantially equal; and p. closing said second transfer check valve in said second transfer line in order to seal said further pressurized gas within said first storage tank.

10. A method as recited in claim 9, wherein:

a. said first output check valve in said first transfer line is an automatic valve which opens whenever said pressure in said upper chamber of said first boiler exceeds said pressure within said upper chamber of said second boiler; and b. said second output check valve in said second transfer line is an automatic valve which opens whenever said pressure within said upper chamber of said second boiler exceeds said pressure within said first storage tank.

11. A method as recited in claim 9, further comprising:

a. providing an intake line connecting said upper chamber of said first boiler to said external source of gas;

b. providing an input check valve in said intake line movable between an open position and a closed position;

c. opening said input check valve in order to allow gas to flow from said external source of gas into said upper chamber of said first boiler; and d. closing said input check valve.

12. A method as recited in claim 9 wherein said steps of applying sufficient heat to said first and second liquids are performed by applying heat from a source selected from the group consisting of solar energy, waste heat, and geothermal energy.

13. A method as recited in claim 9, wherein said movable barrier is selected from the group consisting of an expandable diaphragm, a bellows, and a piston.

14. A method for compressing and storing a gas, comprising:

a. providing a first boiler, said first boiler being segregated by a movable barrier into an upper chamber above said movable barrier and a lower chamber below said movable barrier, said movable barrier remaining within said boiler;

b. providing a second boiler, said second boiler being segregated by a movable barrier into an upper chamber above said movable barrier and a lower chamber below said movable barrier, said movable barrier remaining within said second boiler;

c. providing a first storage tank;

d. providing a second storage tank;

e. providing a first transfer line between said first boiler and said second storage tank;

f. providing a first transfer check valve in said first transfer line movable between an open position and a closed position;

g. providing a second transfer line between said second boiler and said first storage tank;

h. providing a second transfer check valve in said second transfer line movable between an open position and a closed position;

i. providing a third transfer line between said second storage tank and said second boiler;

j. providing a third transfer check valve in said third transfer line movable between an open position and a closed position;

k. providing a first liquid in said lower chamber of said first boiler;

l. providing a second liquid in said lower chamber of said second boiler;

m. providing an external source of gas to be compressed in said upper chamber of said first boiler;

n. applying sufficient heat to said first liquid in said lower chamber of said first boiler to convert at least a portion of said first liquid into a pressurized vapor, thereby moving said movable barrier within said first boiler toward said upper chamber and compressing said gas within said upper chamber of said first boiler;

o. opening said first transfer check valve in said first transfer line in order to allow said pressurized gas in said upper chamber of said first boiler to move into said second storage tank until such time as the pressure within said second storage tank and said upper chamber of said first boiler are substantially equal;

p. closing said first transfer check valve;

q. opening said third transfer check valve in said third transfer line in order to allow said pressurized gas in said second storage tank to move into said upper chamber of said second boiler until such time as the pressure within said upper chamber of said second boiler and said second storage tank are substantially equal;

r. closing said third transfer check valve;

s. applying sufficient heat to said second liquid in said lower chamber of said second boiler to convert at least a portion of said second liquid into a pressurized vapor, thereby moving said movable barrier within said second boiler toward said upper chamber and further compressing said gas within said upper chamber of said second boiler;

t. opening said second transfer check valve in said second transfer line in order to allow said further pressurized gas in said upper chamber of said second boiler to move into said first storage tank until such time as the pressure within said first storage tank and said upper chamber of said second boiler are substantially equal; and u. closing said second transfer check valve in said second transfer line in order to seal said further pressurized gas within said first storage tank.

15. A method as recited in claim 14, wherein:

a. said first output check valve in said first transfer line is an automatic valve which opens whenever said pressure in said upper chamber of said first boiler exceeds said pressure within said upper chamber of said second boiler;

b. said second output check valve in said second transfer line is an automatic valve which opens whenever said pressure within said upper chamber of said second boiler exceeds said pressure within said first storage tank; and c. said third output check valve in said third transfer line is an automatic valve which opens whenever said pressure in said second storage tank exceeds said pressure within said upper chamber of said second boiler.

16. A method as recited in claim 14, further comprising:

a. providing an intake line connecting said upper chamber of said first boiler to said external source of gas;

b. providing an input check valve in said intake line movable between an open position and a closed position;

c. opening said input check valve in order to allow gas to flow from said external source of gas into said upper chamber of said first boiler; and d. closing said input check valve.

17. A method as recited in claim 14 wherein said steps of applying sufficient heat to said first and second liquids are performed by applying heat from a source selected from the group consisting of solar energy, waste heat, and geothermal energy.

18. A method as recited in claim 14, wherein said movable barrier is selected from the group consisting of an expandable diaphragm, a bellows, and a piston.

19. A method as recited in claim 14, further comprising:

a. providing an output line connected to said first storage tank; and b. providing a control valve in said output line movable between an open position and a closed position.

20. A method as recited in claim 15, further comprising:

a. providing an intake line connecting said upper chamber of said first boiler to said external source of gas;

b. providing an input check valve in said intake line movable between an open position and a closed position;

c. opening said input check valve in order to allow gas to flow from said external source of gas into said upper chamber of said first boiler; and d. closing said input check valve.

* * * * *